US006012601A

United States Patent [19]

Van Dam

[11] Patent Number: 6,012,601

[45] **Date of Patent: *Jan. 11, 2000**

[54] METAL CAN WITH PROFILED BODY

[75] Inventor: Willem Leendert Pieter Van Dam, Epe, Netherlands

[73] Assignee: Schmalbach-Lubeca Nederland B.V., Deventer, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,408

[22] Filed: Oct. 31, 1997

[30] Foreign Application Priority Data

Nov. 1, 1996 [NL] Netherlands ..... 1004404

[51] Int. Cl.[7] ..... B65D 6/02

[52] U.S. Cl. ..... 220/667; 220/907; 220/674

[58] Field of Search ..... 220/906, 907, 220/666, 667, 674, 673, 672, 671, 670, 669

[56] References Cited

U.S. PATENT DOCUMENTS

| | | | |
|---|---|---|---|
| D. 98,445 | 2/1936 | McManus | 220/906 |
| 423,833 | 3/1890 | Stiveson | 220/673 |
| 624,911 | 5/1899 | Conderman | 220/673 |
| 664,185 | 12/1900 | Stran | 220/673 |
| 1,249,606 | 12/1917 | Eaton | 220/673 |
| 2,139,143 | 12/1938 | Wiswell | 220/907 |
| 2,335,260 | 11/1943 | Chamberlain | 220/670 |
| 3,401,826 | 9/1968 | Anthony | 220/72 |
| 4,512,490 | 4/1985 | Frei et al. | 220/673 |

FOREIGN PATENT DOCUMENTS

| | | | |
|---|---|---|---|
| 2569656 | 3/1986 | France . | |
| 9112620 | 5/1992 | Germany . | |
| 405051036 | 3/1993 | Japan | 220/666 |
| 405097143 | 4/1993 | Japan | 220/666 |
| 339346 | 12/1930 | United Kingdom . | |

*Primary Examiner*—Stephen Castellano
*Attorney, Agent, or Firm*—Webb Ziesenheim Logsdon Orkin & Hanson, P. C.

[57] ABSTRACT

A sheet-metal can for foodstuffs or drink, comprising a body and a bottom fixed thereto or formed integrally therewith, which body has a generally rotation-symmetrical form onto which a pattern of depressions is superimposed and is characterized by at least one peripherally extending strip-like part present at a distance from the axial ends of the body and free of depressions.

4 Claims, 2 Drawing Sheets

METAL CAN WITH PROFILED BODY

BACKGROUND OF THE INVENTION

The invention relates to a sheet-metal can for foodstuffs or drink, comprising a body and a bottom fixed thereto or formed integrally therewith, which body has a generally rotation-symmetrical form onto which a pattern of depressions is superimposed. Such a can is known and comprises a pattern extending peripherally with repeating of recesses extending the in longitudinal direction of the can such that a cross-section through the can displays a general wave shape superimposed onto the general circular shape.

Such a can has the drawback that, with the use of foodstuffs or drink under a certain pressure, for instance soft drinks, the internal pressure in the can may rise so high after closing thereof that the depressions are pressed outward by the outward directed pressure. In the best case this could result in these depressions more or less disappearing. In practice however, it is found that outward pressing of the depressions is a stochastic process which does not allow of control. An unchecked outward pressing of the depressions thereby occurs in a random, uncontrolled pattern. The result thereof may be that the can acquires a less attractive appearance, while in the case a tangential component is changed the end surfaces, particularly bottom and cover, of the can are no longer parallel, whereby the stackability of the cans is adversely affected.

SUMMARY OF THE INVENTION

In respect of the above the invention has for its object to embody a sheet-metal can of the stated type such that the danger of outward pressing of depressions is considerably reduced or even wholly eliminated.

For this purpose the sheet-metal can of the invention has the feature that at least one peripherally extending strip-like part is present at a distance from the axial ends of the body and is free of depressions.

A specific embodiment has the feature that the depressions are elongate and have a considerable axial component. Depressions extending in the longitudinal direction have only an axial component. There is both an axial and tangential component in the case where the elongate depressions have an oblique, for instance a generally helical, structure.

The can according to the invention preferably has the feature that the body has its largest diameter in the region of the strip-like part. This variant has the advantage that, during transport following manufacture of the can, the cans roll easily against each other with mutual engagement of the respective strip-like parts without the cans being able to make mutual contact in the region of the depressions. This expedites a smooth transport and reduces the risk of damage to the cans by impact forces.

Another embodiment is characterized by two strip-like parts situated at a mutual distance.

BRIEF DESCRIPTION OF THE DRAWINGS

The invention will now be elucidated with reference to the annexed drawings. Herein.

DESCRIPTION OF THE PREFERRED EMBODIMENTS

Figure 2:
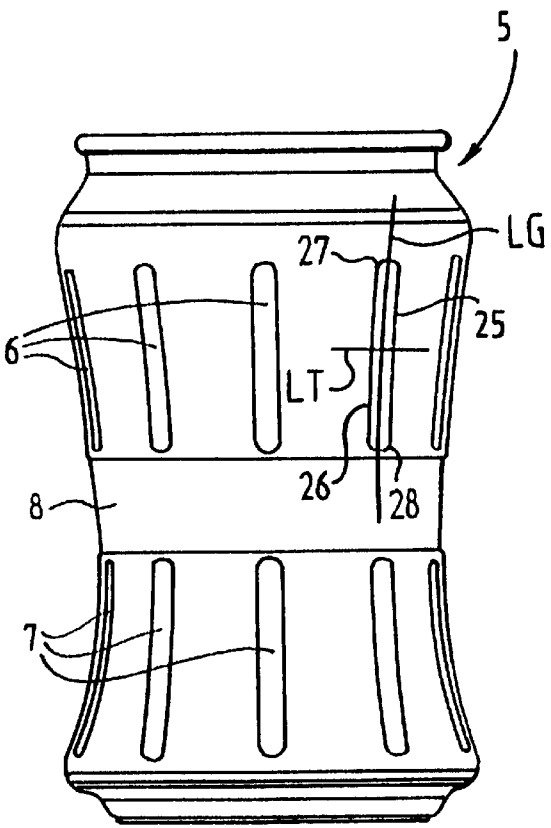
FIG. 2 is a side view of a first embodiment of the invention.
Figure 1:
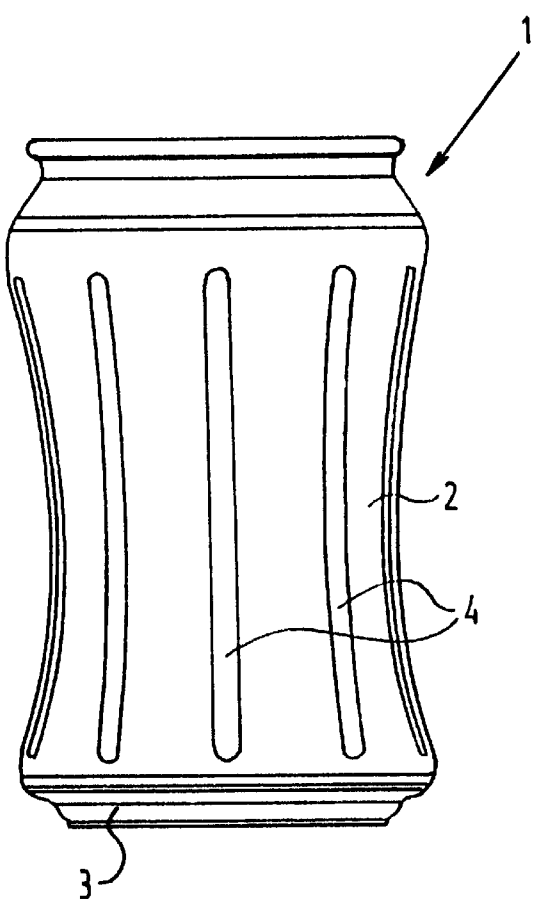
FIG. 1 is a side view of a prior art can.

FIG. 1 shows a sheet-metal can 1 for carbonated soft drinks. The can comprises a body 2 and an integrated bottom 3 connected thereto. The body has a generally rotation-symmetrical form and is provided with schematically designated recesses 4 extending in longitudinal direction. As shown in FIG. 2, each recess has a longitudinal plane LG, a lateal plane LT, a first edge 25, a second edge 26, a first end 27, and a second end 28, wherein the first edge 25 and the second edge 26 are aligned parallel to a line on the longitudinal plane LG and to each other. Attention is drawn to the fact that this is only an example and that there may also be depressions with a width larger than, and even considerably larger than, shown in FIG. 1. It will be apparent that comparatively narrow depressions are less susceptible to undesired outward displacements resulting from internal pressure. It should therefore be understood that the invention aims generally at a stiffening of the can structure such that depressions of somewhat substantial dimensions are less susceptible to an outward displacement.

FIG. 2 shows a can 5 which differs from can 1 of FIG. 1 in the sense that a non-profiled strip-like zone 8 with a constant radius about its periphery is situated in the middle zone between depressions 6, 7. It will be apparent that a tangential tensile strength is hereby obtained and this effectively prevents the depressions 6, 7 moving outward under internal pressure.

Figure 3:
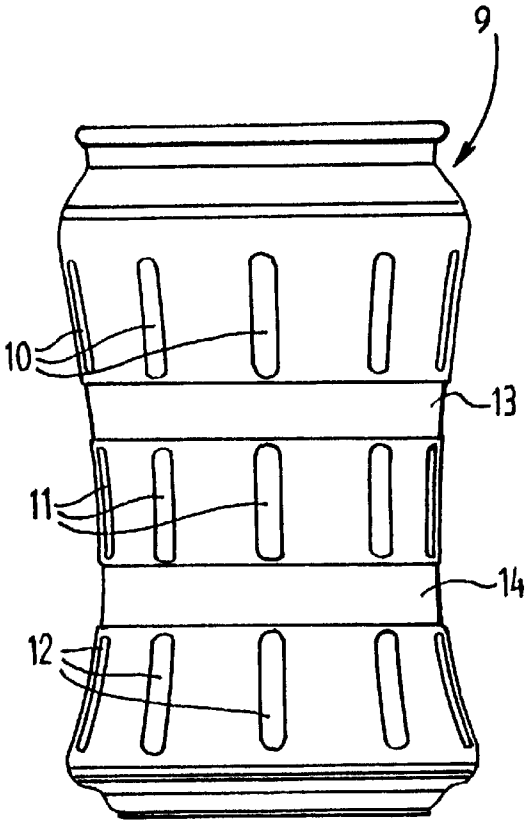
FIG. 3 is a side view of a second embodiment.

FIG. 3 shows a can 9 with three groups of elongate depressions 10, 11, 12 which are separated by non-profiled strips 13, 14.

Figure 4:
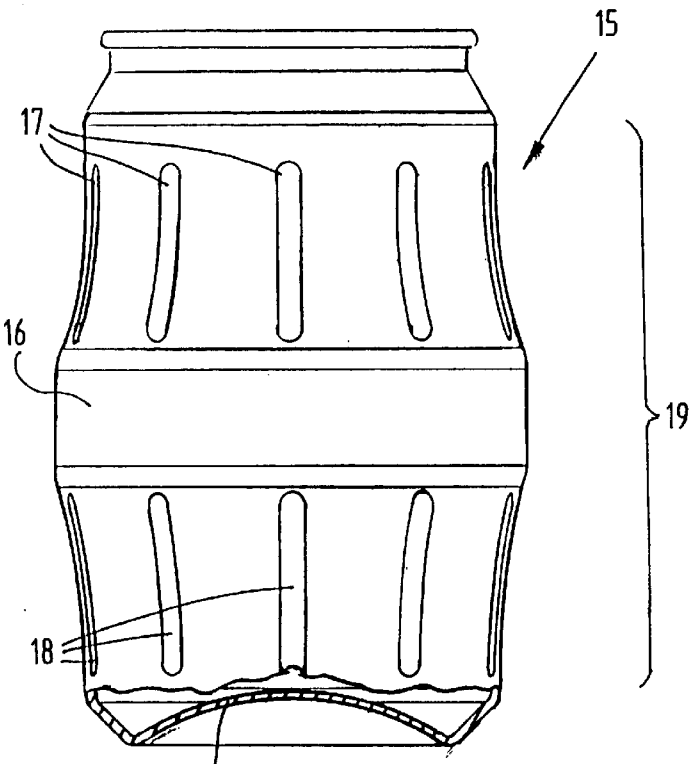
FIG. 4 shows a third embodiment, partly in side view and partly in cross-section.

FIG. 4 shows a can 15 with a different shape. Unlike the can 5 of FIG. 2, the can has with its non-profiled strip-like central zone 16 a widened form between the profiled zones with elongate depressions 17, 18 respectively. Because the non-profiled strip 16 is circular and forms the widest part of the can, adjacent cans only make mutual contact on this non-profiled zone when the cans are arranged together, for instance during transport.

The can 15 is a so-called two-part can, wherein body 19 and bottom 20 are formed integrally.

The can 15 as well as the other cans described here can be manufactured by first making a basic can which is then subjected to a modelling process, for instance by means of an expanding mandrel, explosive deformation or other suitable modelling technique.

Figure 5:
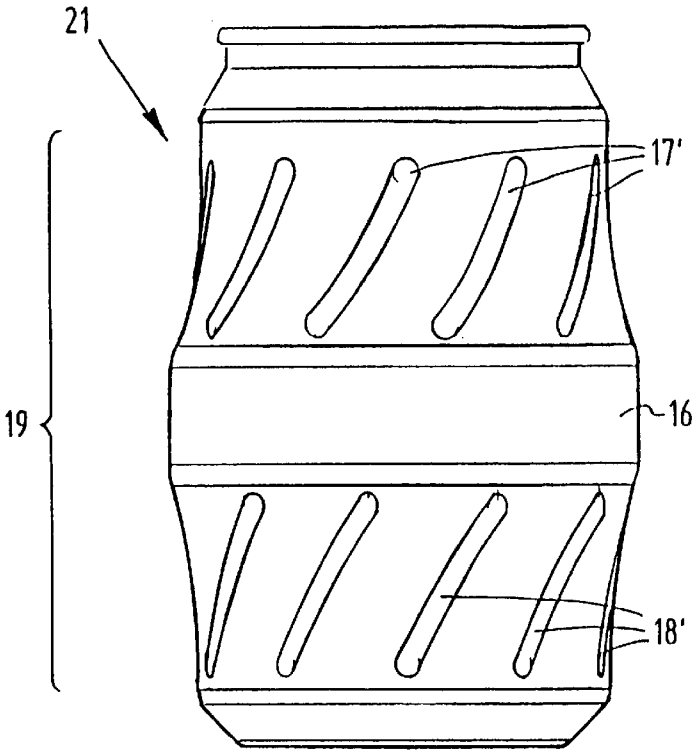
FIG. 5 shows a side view of a fourth embodiment.

FIG. 5 shows a can 21 with elongate depressions 17', 18' which, unlike depressions 17, 18 of FIG. 4 are not directed in longitudinal direction but have an oblique position.

Figure 6:
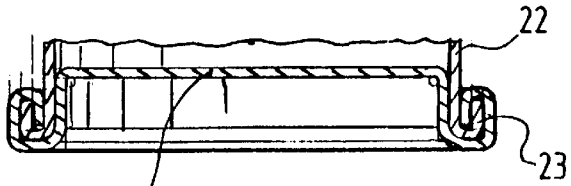
FIG. 6 shows a cross-section through an alternative bottom construction.

FIG. 6 shows that a body 22 of a can does not have to be formed integrally with a bottom, as with the can 15 of FIG. 4, but that a bottom 24 can be connected sealingly to a body 22 via a seam-folded edge 23.

I claim:

1. A sheet-metal can for foodstuffs or drink, comprising a longitudinally extending, rotation-symmetrical body having opposing axial ends, a peripherally extending non-profiled strip-like part, and a pattern of superimposed depressions, each drepression having an axially extending first edge and an axially extending second edge, wherein the non-profiled strip-like part is present at a distance from the axial ends of the body and has a constant radius about the periphery of the body, the first edge and the second edge of each depression are aligned parallel to each other, and each depression is positioned between and spaced away from the opposing axial ends and the non-profiled strip-like part of the body.

2. The can as claimed in claim 1, wherein the depressions are elongate and generally oriented in the longitudinal direction.

3. The can as claimed in claim 1, wherein the body has its largest diameter in the region of the strip-like part.

4. The can as claimed in claim 1, wherein two non-profiled strip-like parts are equally spaced along the can.

* * * * *